US005152443A

United States Patent [19]

Hagan

[11] Patent Number: 5,152,443

[45] Date of Patent: Oct. 6, 1992

[54] UTILITY BELT

[76] Inventor: Michael Hagan, 16149 Redmond Way, #230, Redmond, Wash. 98052

[21] Appl. No.: 725,541

[22] Filed: Jul. 3, 1991

[51] Int. Cl.[5] ..... A45F 5/00

[52] U.S. Cl. ..... 224/252; 224/226; 224/904

[58] Field of Search ..... 224/904, 224, 252, 253, 224/226, 269, 215, 211, 262; 2/311, 312, 338, 336

[56] References Cited

U.S. PATENT DOCUMENTS 4,747,527 5/1988 Trum Power II ..... 224/224

4,932,576 6/1990 Ashley ..... 224/904

5,004,136 4/1991 Leath ..... 224/904

5,016,797 5/1991 Burow ..... 224/224

*Primary Examiner*—Linda J. Sholl

*Attorney, Agent, or Firm*—Michael J. Folise

[57] ABSTRACT

A multi-segmented utility belt which employs a plurality of substantially rigid sections connected by flexible portions. A variety of different tool holders can be pivotally and rotatably supported from the belt. The belt is provided with a hinge mechanism permitting an intermediate section to be inserted or removed from the left and right hand sections thus grossly varying the size of the belt.

20 Claims, 5 Drawing Sheets

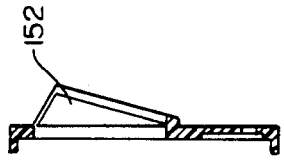
FIG. 4
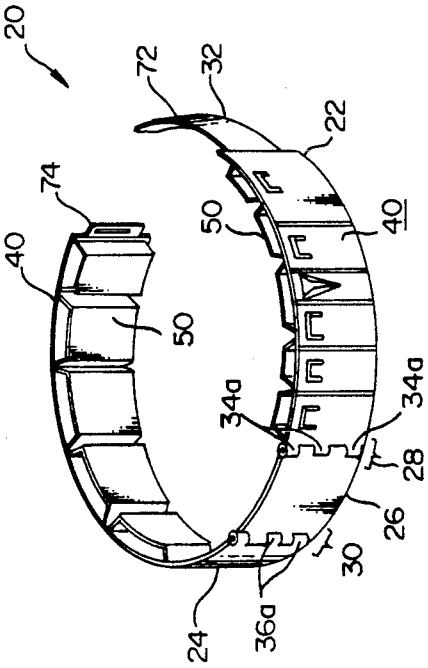
FIG. 1
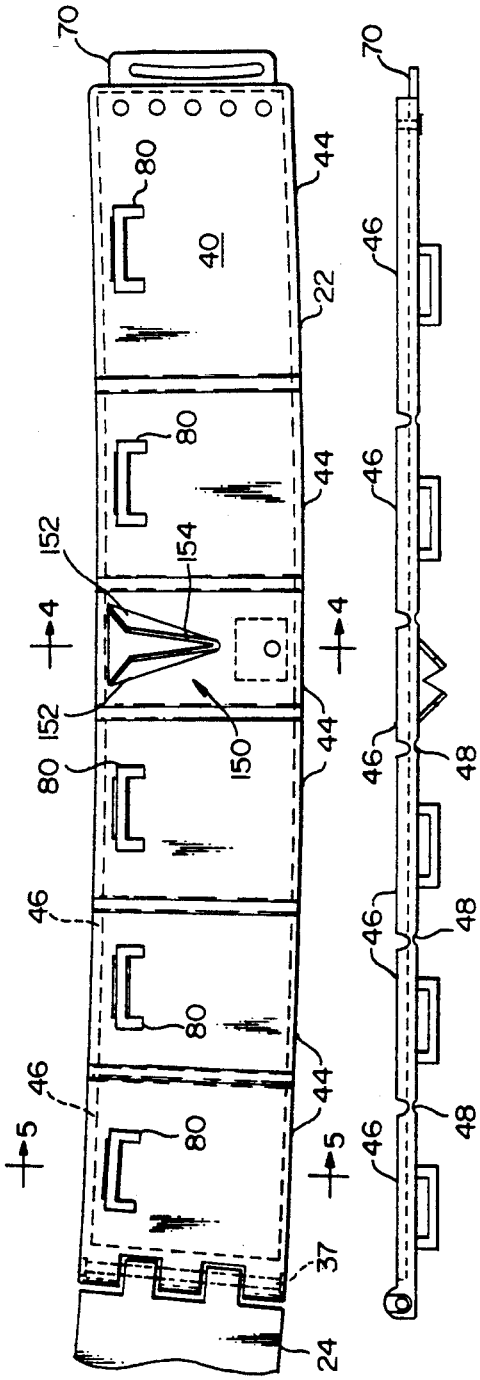
FIG. 2
FIG. 3

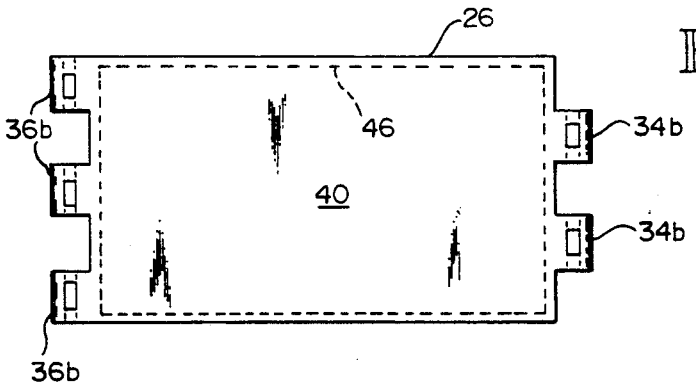
FIG. 9
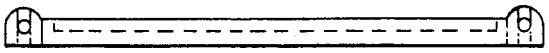
FIG. 10A
FIG. 10B
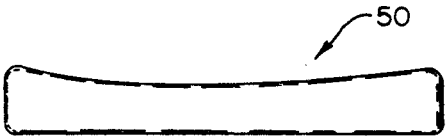
FIG. 12
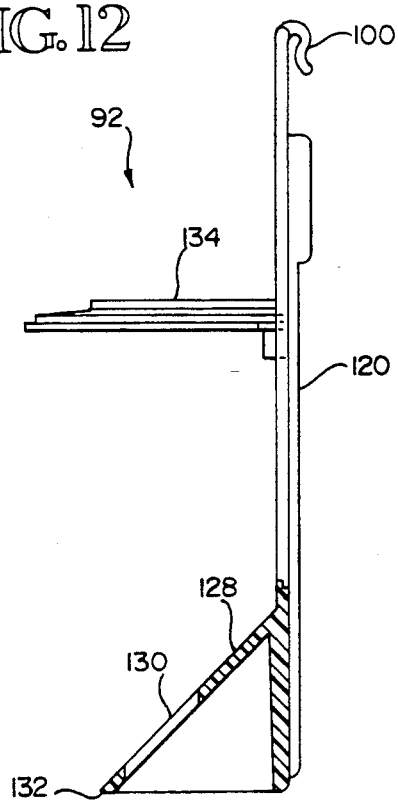
FIG. 11
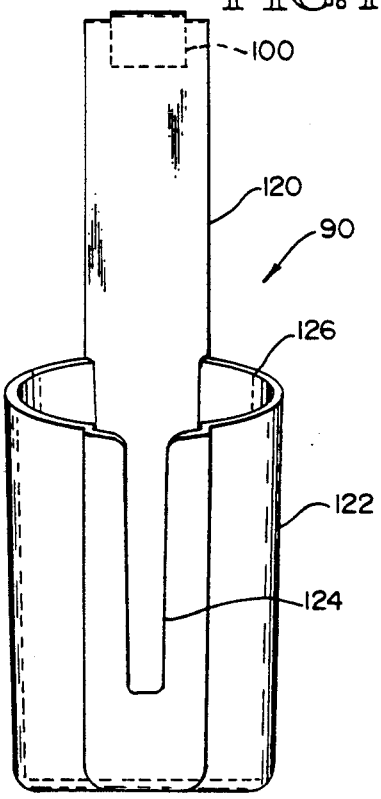

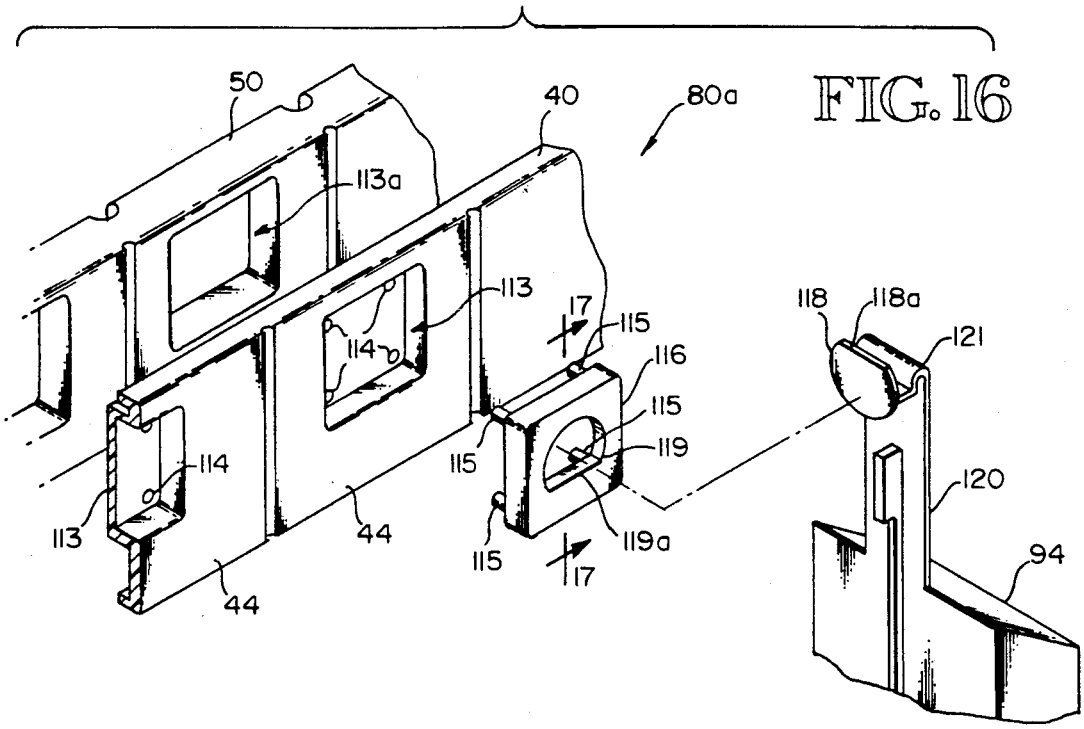
FIG. 16
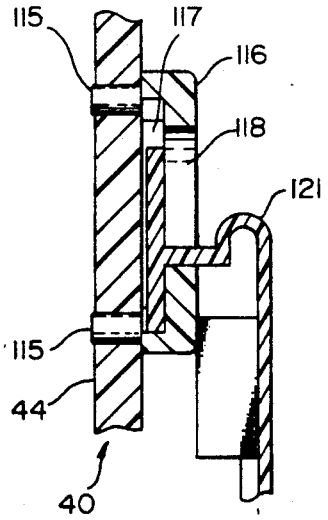
FIG. 17
FIG. 18
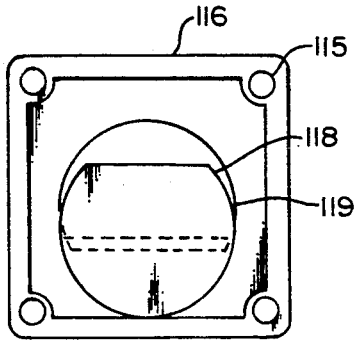

UTILITY BELT

TECHNICAL FIELD

The invention relates to an apparatus for supporting a plurality of tools, utensils and other implements from the waist of a workman, janitor or the like. More specifically, the invention relates to utility belts which support a plurality of heavy tools, utensils, etc. from the waist of a user without substantially interfering with the user's mobility and flexibility.

BACKGROUND OF THE INVENTION

The need for a utility belt which supports one or more tools, implements, utensils or the like from the waist of a user has been recognized for some time. As a result of this need, utility belts have been designed specifically for policemen, soldiers, carpenters and other specialized trades persons.

A policeman's belt generally comprises a leather belt having a conventional buckle. A handgun holster, handcuff pouch, night stick and other devices are typically attached to the belt by means of a loop on the back of each of these devices through which the belt is threaded. Utility belts of this type are flexible in a vertical plane and are therefore comfortable. However, belts of this type are not well suited for carrying heavy tools.

A conventional soldier's belt comprises a cotton belt having a plurality of grommets therethrough arranged in vertical pairs. A pronged device is then used to pivotally attach canteens and other implements to the grommets in the belt. This design offers superior mobility to the soldier because the implements can swing in a vertical plane from the waist of the soldier, thus facilitating easy striding and bending motions. However, this belt cannot comfortably support a substantial amount of weight from the waist of the soldier without discomfort because the belt itself does not have substantial rigidity in a vertical direction.

Carpenter's aprons (structurally more similar to a belt than a conventional apron) are available which provide a plurality of leather loops connected to an underlying leather belt by rivets. The loops can receive a variety of tools such as hammers, screw drivers, and the like. Open-ended pouches are often riveted on to the underlying belt to serve as a receptacle for nails. Although the carpenter's belt can support substantial weight from the waist of a user because the underlying leather belt has some vertical rigidity, this design tends to restrict the motion of the wearer and is not usually adaptable to receive implements other than conventional carpenter and framing tools. Stated another way, this design is typically implement specific.

None of the above designs adequately combine the ability to support heavy loads from the waist of a user comfortably while providing a full range of bending motions for the user. Presently available designs are limited in this respect principally because vertical rigidity (which permits substantial loads to be carried by the user) generally results in an uncomfortable belt. Certain padded belts are available on external frame backpacks which address this problem by providing heavy padding in the hip area. However, the backpack hip belt itself is substantially flexible vertically and is only able to support substantial weight on the hips of a user because an external frame (the backpack frame) is attached to the belt. Thus, such a belt would not be well adapted for use as a utility belt.

Therefore, a need exists for a utility belt which can support substantial weight from the waist of a user comfortably and which does not impede striding and bending motions. Furthermore, a need exists for a utility belt which is readily adaptable to support a variety of different tools, utensils, and implements and which is not utensil specific.

DISCLOSURE OF THE INVENTION

It is therefore an object of the present invention to provide a utility belt which can comfortably support heavy loads from the waist of a user without causing discomfort to the user.

It is another object of the present invention to support heavy loads from the waist of a user without substantially impeding bending or striding movements of the user.

It is yet another object of the present invention to provide a utility belt as described above which can also interchangeably support a plurality of different implements and implement holders.

It is yet a further object of the present invention to achieve the above objects with a utility belt which can easily adjust to users having different sized waists.

These objects, and other objects and advantages which will be apparent from the description which follows, are achieved by providing a multi-section utility belt which pivotally supports a plurality of cleaning tools, tool holders, and other products from the waist of a user. The multi-section design of the utility belt achieves this function by providing substantial rigidity in a vertical direction, substantial flexibility in a horizontal plane, and padded sections corresponding to the multi-section construction of the belt to cushion the belt against the user's body. An outer side of the belt is provided with a plurality of hanging devices which pivotally support any one of a variety of tool holders on the outer side of the belt.

In its preferred embodiment, the utility belt includes an outer, multi-segmented belt having substantially rigid sections connected by substantially flexible portions. An inner belt having a plurality of segmented cushions is bonded to the outer belt to transfer weight from the rigid sections, through the cushioned sections, to the user's hips.

The belt can be constructed with a left hand section and a right hand section which are joined by a pinned hinge. To increase the size of the belt for a larger user, the pin can be removed to separate the left and right hand sections and an intermediate spacer section having mating hinge portions can be inserted therebetween and pivotally connected to the left and right hand sections, respectively by two pins. Thus, a wide range of sizes can be accommodated by providing only a single size of left and right hand sections. A hook and loop closure strap is provided on the free ends of the belt to precisely size the belt circumference to the waist of the individual user.

The hanging devices on the outside of the belt can comprise horizontal, cylindrical members supported on struts in a spaced relationship from the outer side of the outer belt. Tool support devices having hooks on one end thereof can be hung in a pivotal fashion from the cylindrical members. The hooks are preferably constructed with an open mouth having a size slightly smaller than the diameter of the cylindrical members so that the hook releasibly engages the cylindrical member.

In an alternate embodiment of the invention, the hanging devices comprise a rotating hinge permitting the tool support device to both swing away from the user's body and to rotate in a plane defined by the outer, multi-segmented belt. The belt can then be stored in a vertical position without forcing the tool support devices to extend therefrom in a perpendicular fashion against the force of gravity.

BRIEF DESCRIPTION OF THE DRAWINGS

FIG. 1 is an isometric view of a utility belt in accordance with the present invention.

FIG. 2 is a side elevational view of an outer section of the belt.

FIG. 3 is a top elevational view of the outer belt section shown in FIG. 2.

FIG. 4 is a sectional, elevational view taken along line 4—4 in FIG. 2.

FIG. 9 is a rear elevational view of an intermediate outer section of the belt.

FIG. 10*a* is a top elevational view of an intermediate section shown in FIG. 9.

FIG. 10*b* is a top plan view of a cushion section for attachment to an inner side of the intermediate section shown in FIG. 9.

FIG. 11 is a front elevational view of a spray bottle holder support device for use with the utility belt.

FIG. 12 is a side elevational view of a support device similar to the device shown in FIG. 11 except that the device shown in FIG. 12 is for use with a brush.

FIG. 16 is an exploded, partial isometric view of an alternate pivot mechanism embodiment of the present invention.

FIG. 17 is a sectional, elevational view taken along line 17—17 of FIG. 16.

FIG. 18 is a rear plan view of the alternate pivot mechanism embodiment of FIG. 16.

BEST MODE FOR CARRYING OUT THE INVENTION

Figure 8:
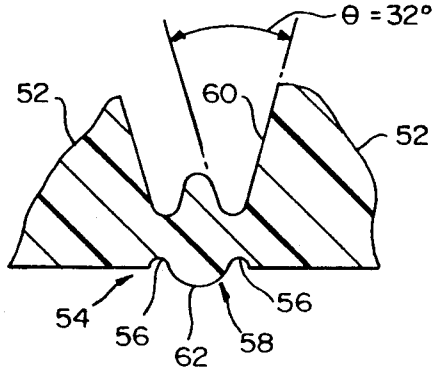
FIG. 8 is an enlarged, sectional, top view of circled area 8 in FIG. 7 taken along line 8—8 in FIG. 6.

A utility belt, in accordance with the principals of the invention is generally indicated at reference numeral 20 in FIG. 1. The utility belt is particularly useful for carrying a plurality of heavy objects, tools, implements and tool holders pivotally from an exterior portion of the belt while providing the wearer with full flexibility and range of motion, including an unencumbered striding motion. The belt is substantially rigid in a vertical direction, substantially flexible in a horizontal plane, and substantially cushions the user's waist and hips so as to distribute the load evenly to the wearer.

The belt 20 includes a right hand section 22, a left hand section 24, and an intermediate section 26 which is pivotally connected to the right and left sections by a right hand hinge mechanism 28 and a left hand hinge mechanism 30. The right and left hand sections are mirror images of one another except for the mating portions of their respective hinge mechanisms. The belt is also provided with a hook and loop closure strap device 32 to precisely adjust the size of the belt around the waist of the user. To grossly reduce the size of the belt, the intermediate section 26 can be removed and the left and right hand sections 24, 28 can be directly connected to one another through their respective hinge mechanisms.

The right hand section 22 has three right hand hinge tongues 34*a* while the left hand section 24 has two left hand hinge tongues 36*a*. The tongues are appropriately spaced so that they can mate with one another when a pin (not shown) is positioned through a bore 37 (See FIG. 2) in the tongues. As best seen in FIG. 9, the intermediate section 26 is provided with corresponding right hand hinge tongues 34*b* and corresponding left hand hinge tongues 36*b* so as to mate with the appropriate left hand and right hand sections.

The right and left hand belt sections 22, 24 each have a length of approximately 24 inches while the intermediate section 24 has a length of approximately $5\frac{1}{2}$ inches. Thus, the total length of the belt is approximately $53\frac{1}{2}$ inches. By removing the intermediate section 26 and pinning the left and right hand sections together, the size of the belt is reduced by approximately $5\frac{1}{2}$ inches. In a second embodiment of the invention, the left and right hand sections each have a length of approximately 18 inches thus providing for a smallest belt with a length of 36 inches. The smallest belt can be enlarged by $5\frac{1}{2}$ inches by inserting an intermediate section 24 between the left and right hand sections.

To provide the required vertical rigidity, horizontal flexibility, cushioning and load distributing characteristics described hereinabove, the right hand 22, left hand 24 and intermediate section 26 are provided with a two-part, inner belt/outer belt construction. As best seen in FIGS. 2, 3, 9 and 10*a*, each section is provided with an outer belt portion 40. With respect to the left and right hand sections 22, 24, the outer belt portion comprises a plurality of substantially rigid segments 44 having peripheral, inwardly directed ridges so as to provide each segment with substantial vertical and torsional rigidity. Each segment is connected to an adjacent segment by a reduced thickness portion 28 having a thickness of approximately 0.130 inch while each segment has a thickness of approximately 0.150 inch and the ridges have a thickness of approximately 0.30 inch. Thus, the right and left hand sections are substantially flexible only at the reduced thickness portions in a horizontal plane while the higher section is substantially rigid in the vertical plane. The outer portions 40 are preferably manufactured from an injection molded elastomeric such as santoprene.

Figure 6:
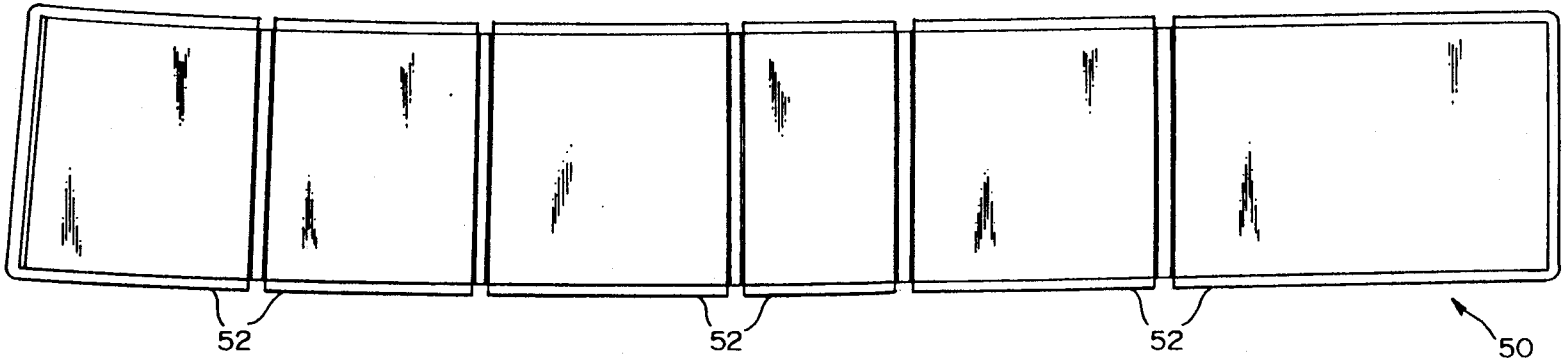
FIG. 6 is a side elevational view of a right hand side inner cushion belt section which is attachable to an inner side of the outer belt section shown in FIG. 2.
Figure 7:
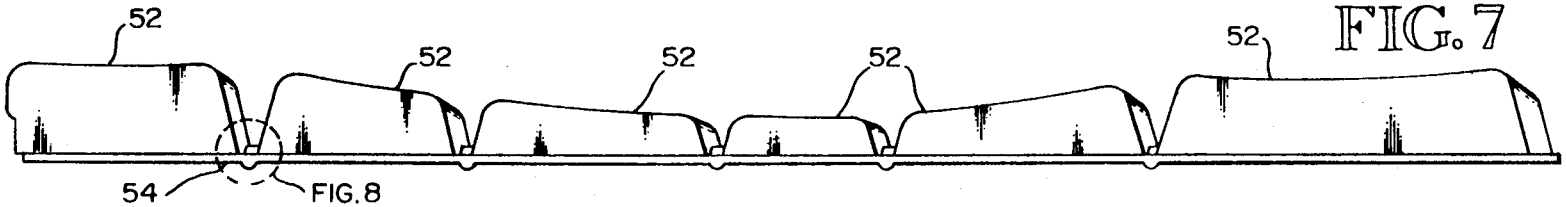
FIG. 7 is a top plan view of the inner belt shown in FIG. 6.

The cushion function of the utility belt is performed by multi-segment inner belt sections generally indicated at reference numeral 50 in FIGS. 1, 6 and 7. Each inner belt section has one or more segments 52 which are sized and positioned to correspond to an be closely received by the segments 44 on the outer belt portion 40 of the right, left and intermediate sections 22, 24 and 26. Each segment 52 on the inner belt 50 is connected to an adjacent segment by a connecting member 54 shown in an enlarged top plan section in FIG. 8.

The connecting member has two reduced thickness portions 56 having a thickness of approximately 0.130 inch on lateral sides of an enlarged thickness bead 58. The bead has a thickness of approximately 0.135 inch. The bead and adjacent sidewall 60 of a segment 52 form an angle $\theta$ of approximately 32°. This angle provides the desired degree of horizontal flexibility between the adjacent segments 52 without having the adjacent segments compressed against one another when the utility belt 10 is in a horizontal plane. The protrusion 62 on the bead 58 is sized to be appropriately received in the adjacent reduced thickness portion 48 of the outer belt portion 40. The height and width dimensions of the individual segments are sized so as to be received by the peripheral, inwardly directed ridges 46 on the outer belt portion. The inner belt portion 50 is preferably constructed from a self-skinning low density foam such as injection mold urethane foam and is preferably bonded to an inner side of the left and right hand sections by an appropriate adhesive such as cyanoacrylate. Each section 52 is tapered vertically and horizontally as shown in FIG. 7 to comfortably fit the contours of the user's body. Generally, each section tapers from an enlarged dimension at the top to a reduced dimension at the bottom and from an enlarged dimension towards the end of each portion to a reduced thickness in the middle of each portion as it otherwise shown in FIG. 7. These dimensions generally vary from a maximum of approximately one inch to a minimum of approximately 0.350 inch.

The hook and loop closure strap 32 shown in FIG. 1 is connected to a closed metal loop 70 shown in FIG. 2. The strap 32 is preferably made of nylon. Both the hook portion and the loop portion of the hook and the loop closure are preferably on the outwardly facing surface 72 of the strap. The closed metal loop 70 is provided on the free end of the right hand section 22 of the belt. The free end of the left hand section 24 carries an open-ended metal hook 74 similar to the closed metal loop 70 except the lower end thereof is open. After the user positions the belt around his or her waist, the free end of the strap 72 is threaded through the open end of metal hook 74. The wearer then cinches the strap 72 to the appropriate tightness and engages the hook and loop surfaces. The belt can then be quickly released by lifting up on the left hand section 24 with respect to the right hand section 22. To resecure the belt, the user need only hook the open end of open-ended metal hook 74 to the loop which has just been created midway in the strap 72.

Figure 5:
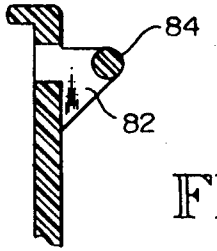
FIG. 5 is a sectional, enlarged elevational view of a cylindrical hanger member taken along line 5—5 of FIG. 2.

In order to support a plurality of tools, utensils and the like from the outer surface of the outer belt portion 40, one or more of the segments 44 are provided with a pivotal support structure 80 shown in greatest detail in FIG. 5. The pivotal support structure comprises two outwardly extending struts 82 which support a transverse cylindrical bar 84 between the ends thereof. The bar has a diameter of approximately 0.150 inch and is spaced away from the outer surface of the outer belt portion 40 a distance of approximately 0.20 inch.

Figure 15:
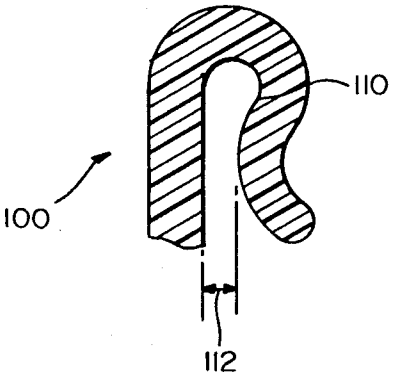
FIG. 15 is an enlarged, sectional view of circled area 15 in FIG. 13.
Figure 13B:
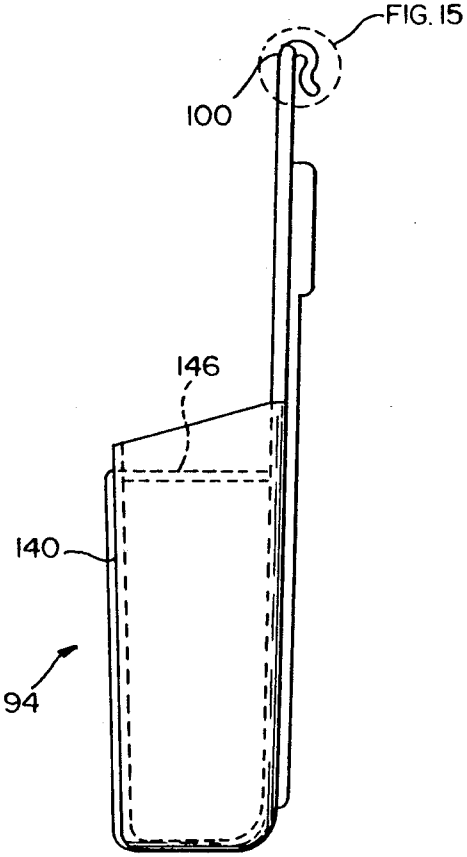
FIG. 13*b* is a side elevational view of the towel support device shown in FIG. 13.
Figure 13A:
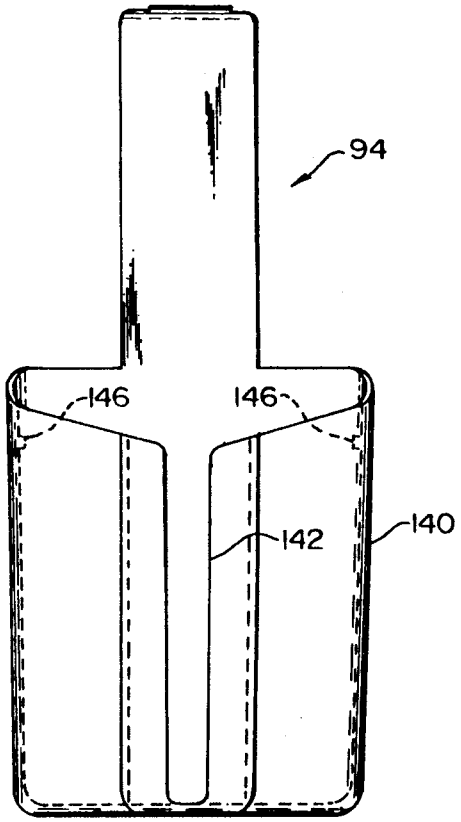
FIG. 13*a* is a front elevational view of a towel holder support device for use with the utility belt.

A plurality of devices such as a spray bottle holder 90 shown in FIG. 11, a brush holder 92 shown in FIG. 12, a multi-fold paper towel holder 94 shown in FIGS. 13*a* and 13*b*, and other similar devices can be pivotally hung from the support structure 80 so as to swing away from the user's body when the user bends over or strides. Each of these holders is provided with a hook 100 which snap fits over the cylindrical bar 84 of the pivotal support structure. As best seen in FIG. 15, the hook 100 defines an inner, substantially cylindrical recess 110 having a diameter of approximately 0.160 inch, slightly larger than the diameter (0.150 inch) of the transverse cylindrical bar 84 which permits free pivotal motion therebetween. However, the cylindrical recess 110 has an open lower end 112 having a width of approximately 0.085 inches so as to releasably retain the cylindrical bar with the cylindrical recess. The hook, and each of the holders is preferably manufactured from polypropylene so as to be somewhat resilient thus permitting the hook 100 to resiliently deform the open end 112 sufficiently to permit passage of the transverse cylindrical bar 84 therethrough.

An alternate embodiment of the pivotal support structure is generally indicated at reference number 80*a* in FIG. 16. In this alternate embodiment, the outer belt 40 has molded therein a substantially square depression 113 in one or more segments 44 of the outer belt. The inner cushioned belt 50 has corresponding depressions 113*a* therein for receipt of the depressions 113 in the outer belt 40.

The depression 113 has four post holes 114 at corners thereof. The post holes are sized and positioned to closely receive four posts 115 on a clip housing 116. As best seen in FIG. 17, the clip housing, when received in the depression 113 provides a cavity 117 for receiving a substantially circular clip portion 118 connected to a tool, utensil, or tool holder such as a multi-fold paper tower holder 94 shown in FIG. 16. The posts are heat staked after insection into the post holes 114 in a conventional manner to retain the clip housing in the depression. The clip portion is substantially circular in shape except for a flat surface 118*a* at an upper edge thereof. The clip housing 116 has a substantially circular aperture 119 having a flat surface 119*a* on the lower edge thereof which corresponds to the flat surface 118*a* on the clip portion 118.

To insert the clip 118 into the aperture 119 for receipt in the cavity 117, paper towel holder 194 is inverted so that the flat surface 118*a* on the clip 118 is aligned with the flat surface 119*a* of the aperture 119. The clip is then inserted through the aperture and counter-rotated to the position shown in FIG. 16 and FIG. 18 (FIG. 18 is a rear, elevational view of the clip inserted into the clip housing with the outer belt 40 removed for clarity. The stem 120 of the multi-fold paper towel holder is provided with a flexible, live hinge 121 to provide the necessary pivoting action away from the body of the user as described hereinabove. The hinge is flexible because the entire paper towel holder mechanism is manufactured from a suitably elastic polymer material such as polystyrene. The thickness of the live hinge 121 is approximately ⅛ of an inch. This thickness permits paper towel holder 94 or other utensils to swing away from the user's body while the circular shape at the lower end of the clip portion 118 rides against a bottom surface of the clip housing 116 as a rotational bearing.

The spray bottle holder 90 shown in FIG. 11 has an elongated stem 120 connected to the hook 100 and also supports at its lower end a cup-shaped receptacle 122. The receptacle has a diameter of approximately 2.90 inches at the bottom thereof and is slightly tapered to a larger diameter at the upper, open end. Vertical slot 124 is provided within the cup-shaped receptacle so that the upper, open end of the receptacle can receive a spray bottle having a diameter slightly larger than the receptacle. The open end 126 of the receptacle is also downwardly angled at an angle of approximately 15° to facilitate insertion of a spray bottle into the opening by feel alone.

The brush holder 92 also has a stem 120 similar to the stem on the spray bottle holder 90. The lower end of the stem is provided with a downwardly angled base 128 defining an aperture 130 having an open end 132 for receiving the handle of a brush such as a toilet brush. A substantially circular cap 134 is provided intermediate the hook 100 and angled base 128 to protect the user from the end of the brush when received in the holder.

Figure 14:
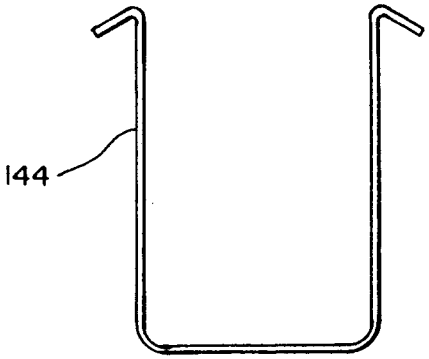
FIG. 14 is a multi-fold towel retainer clip for use with the towel holder support device of FIG. 13.

The multi-fold towel holder 94 shown in FIGS. 13*a* and 13*b* is provided with a rectangular cup-shaped receptacle 140 for receiving a cassette 141 in FIG. 14 of multi-fold paper towels. The receptacle is provided with a vertical slot 142 on the outward face thereof to permit multi-fold paper towels to be dispensed from the cassette and through the slot. The substantially U-shaped spring steel cassette 141 shown in FIG. 14 is provided to fit into shoulders 146 within the cup-shaped receptacle 140. The cassette 141 is first loaded into the receptacle 140 so that the paper towels are frictionally restrained against vertical motion in the cup. The paper towels are then loaded into the cassette. In this way, the paper towels will properly feed through the slot 42 and not tend to escape from the cup in a vertical direction.

The outer belt portions 40 are also provided with gripping device 150 for grasping a portion of a rag. The gripping device 150 comprises two triangular wings 152 which are outwardly directed from the surface of the outer belt portion 40 so as to form an open-ended, V-shaped groove 154. As best seen in FIG. 4, the wings 152 have a maximum protrusion of approximately 0.50 inch from the outer surface of the outer belt portion 40.

Those of ordinary skill in the art will upon reviewing this disclosure devise other implement holders of various configurations which employ the concepts described and shown in FIGS. 11–15. Such alternate designs are considered to be within the scope of this disclosure.

The multi-section utility belt described above provides sufficient vertical and torsional rigidity to support heavy loads from the waist of the user. By providing substantially rigid segments 44 interconnected by substantially flexible, reduced thickness portions 48, and by providing a multi-segment cushion inner belt portion 50, the belt retains sufficient flexibility in a horizontal plane and cushioning to be comfortable for the user. The pivoting mechanisms 80, or alternate pivoting mechanism embodiment 80*a* on the outer belt portions permit tools and implements contained in the pivotally connectable holders shown in FIGS. 11–13 to move away from the user's body when the user bends or strides. In addition, the removable nature of the holders permit other holders for different implements to be substituted in accordance with the task to be performed by the user. Thus, the invention achieves the desired result of bearing heavy loads comfortably for a variety of different implements. In addition, the multi-sectional nature of the belt, including a removable intermediate section, allows a variety of different sized users to be fitted without requiring the manufacture of a variety of different section sizes.

Other embodiments and variations of the invention are contemplated which employ the same inventive concepts described hereinabove and shown in the drawings. Therefore, the invention is not to be limited by the above disclosure, but is to be determined in scope by the claims which follow.

I claim:

1. A multi-section utility belt for comfortably supporting a plurality of hand tools and products from the waist of a user, comprising:

an outer belt having substantially flexible left and right hand sections, each section having an inner side, an outer side, and a plurality of relatively rigid outer belt segments connected by relatively flexible, vertically oriented reduced thickness portions, a plurality of the rigid outer belt segments having outwardly directed hangar means on the outer side of the sections for pivotally supporting cleaning tool holders from the rigid segments, the left and right hand sections further having mating left and right hand hinge halves for joining the sections together;

pivotal engagement means for pivotally engaging the left and right hand hinge halves together; and cushion means for cushioning the inner sides of the outer belt left and right sections against the user.

2. The utility belt of claim 1, wherein the cushion means includes an inner belt, bonded to the outer belt, wherein the inner belt has left and right hand sections, each section having a plurality of vertically and horizontally tapered inner belt segments sized to be received by corresponding outer belt segments and each of the inner belt segments being connected to an adjacent inner belt segment by relatively flexible, vertically oriented reduced thickness portions positioned to register with the outer belt reduced thickness portions.

3. The utility belt of claim 2, wherein the reduced thickness portions of the inner belt left and right sections have inwardly directed lobes to control the maximum, relative flexure of the belt and outwardly directed lobes to register with the reduced thickness portions of the outer belt left hand and right hand sections.

4. The utility belt of claim 3, wherein the inner belt left and right sections are made of self-skinning elastomeric material and wherein the outer belt left and right sections are made of injection molded plastic material.

5. The utility belt of claim 1, including an elongated, substantially rigid center section having a cushioned inner side, the center section having left and right hand hinge halves for mating with the hinge halves on the right and left hand sections to create a larger size belt.

6. The utility belt of claim 1, wherein the hangar means has a cylindrical bar horizontally supported in a spaced relationship from the outer side of the segments by struts, and wherein the utility belt includes a cleaning tool holder having a hook portion sized to releasably receive the cylinder whereby the cleaning tool holder can pivot relative to the utility belt when the user bends over.

7. The utility belt of claim 6, wherein the cleaning tool holder is a toilet brush holder having an elongated stem descending from the hook portion and also having an outwardly angled portion defining an aperture and a slot joining a perimeter of the aperture with an edge of the outwardly angled portion so that a stem of a brush can be passed through the slot, the toilet brush holder further having a guard hood portion extending outwardly from the elongated stem between the hook portion and the outwardly angled portion to prevent the user from touching a bristle part of a brush received in the holder.

8. The utility belt of claim 6, wherein the cleaning tool holder is a sponge/multi-fold paper towel holder having an elongated stem descending from the hook portion and also having a substantially rectangular receptacle extending outwardly for receiving a sponge therein, the sponge/multi-fold paper towel holder also having a vertical open ended slot in the rectangular receptacle for dispensing the towels individually, the sponge/multi-fold paper towel holder further having a "U" shaped insert sized to be received in the rectangular receptacle to then be loaded with multi-fold paper towels to facilitate dispensing of the paper towels through the open ended slot.

9. The utility belt of claim 6, wherein the cleaning tool holder is a bottle holder made from a resilient material and having an elongated stem descending from the hook portion and also having a substantially cylindrical receptacle extending outwardly for receiving a spray bottle therein, the cylindrical receptacle having a downwardly sloping top opening and defining a vertical open ended slot to permit resilient enlargement of the receptacle when a bottle is received therein.

10. The utility belt of claim 1, wherein the outer belt left and right hand sections have free ends supporting a closure mechanism, the closure mechanism having a hook and loop strap attached to one free end and an open ended hook attached to the other free end so that the hook and loop strap can be preadjusted to a desired length so as to be quickly engageable and disengageable with the open ended hook.

11. A multi-section utility belt for comfortably supporting a plurality of cleaning tools and products from the waist of a user, comprising:

an outer belt having an inner side, an outer side, and a plurality of relatively rigid outer belt segments connected by relatively flexible, vertically oriented reduced thickness portions, a plurality of the rigid outer belt segments having outwardly directed hangar means on the outer side of the sections for pivotally supporting cleaning tool holders from the rigid segments; and an inner belt bonded to the outer belt and having cushion means for cushioning the inner side of the outer belt against the user.

12. The utility belt of claim 11, wherein the cushion means has a plurality of vertically and horizontally tapered inner belt segments sized to be received by corresponding outer belt segments and each of the inner belt segments being connected to an adjacent inner belt segment by relatively flexible, vertically oriented reduced thickness portions positioned to register with the outer belt reduced thickness portions.

13. The utility belt of claim 12, wherein the reduced thickness portions of the inner belt have inwardly directed lobes to control the maximum, relative flexure of the belt and outwardly directed lobes to register with the reduced thickness portions of the outer belt.

14. The utility belt of claim 13, wherein the inner belt is made of self-skinning elastomeric material and wherein the outer belt is made of injection molded plastic material.

15. The utility belt of claim 11, wherein the hangar means has a cylindrical bar horizontally supported in a spaced relationship from the outer side of the segments by struts, and wherein the utility belt includes a cleaning tool holder having a hook portion sized to releasably receive the cylinder whereby the cleaning tool holder can pivot relative to the utility belt when the user bends over.

16. The utility belt of claim 15, wherein the cleaning tool holder is a toilet brush holder having an elongated stem descending from the hook portion and also having an outwardly angled portion defining an aperture and a slot joining a perimeter of the aperture with an edge of the outwardly angled portion so that a stem of a brush can be passed through the slot, the toilet brush holder further having a guard hood portion extending outwardly from the elongated stem between the hook portion and the outwardly angled portion to prevent the user from touching a bristle part of a brush received in the holder.

17. The utility belt of claim 15, wherein the cleaning tool holder is a sponge/multi-fold paper towel holder having an elongated stem descending from the hook portion and also having a substantially rectangular receptacle extending outwardly for receiving a sponge therein, the sponge/multi-fold paper towel holder also having a vertical open ended slot in the rectangular receptacle for dispensing the towels individually, the sponge/multi-fold paper towel holder further having a "U" shaped insert sized to be received in the rectangular receptacle to then be loaded with multi-fold paper towels to facilitate dispensing of the paper towels through the open ended slot.

18. The utility belt of claim 15, wherein the cleaning tool holder is a bottle holder made from a resilient material and having an elongated stem descending from the hook portion and also having a substantially cylindrical receptacle extending outwardly for receiving a spray bottle therein, the cylindrical receptacle having a downwardly sloping top opening and defining a vertical open ended slot to permit resilient enlargement of the receptacle when a bottle is received therein.

19. The utility belt of claim 11, wherein the outer belt has two free ends supporting a closure mechanism, the closure mechanism having a hook and loop strap attached to one end and an open ended hook attached to the other free end so that the hook and loop strap can be preadjusted to a desired length so as to be quickly engageable and disengageable with the open ended hook.

20. A multi-section utility belt for comfortably supporting a plurality of cleaning tools and products from the waist of a user, comprising:

a plurality of relatively rigid segments each having an inner side and an outer side, each segment connected to an adjacent segment by relatively flexible, vertically oriented reduced thickness portions, a plurality of the rigid segments having outwardly directed hangar means on the outer side of the sections for pivotally supporting cleaning tool holders from the rigid segments;

vertically and horizontally tapered pad segments sized to be received by and bonded to corresponding rigid segments, each of the pad segments being connected to an adjacent pad segment by relatively flexible, vertically oriented reduced thickness portions positioned to register with the reduced thickness portions between adjacent rigid segments for cushioning the inner side of the outer belt against the user; and closure means for closing the belt around the waist of the user.

* * * * *